US005800244A

United States Patent [19]

Barton, Jr.

[11] Patent Number: 5,800,244

[45] Date of Patent: Sep. 1, 1998

[54] SLOTTED MARBLE

[75] Inventor: William M. Barton, Jr., Encinitas, Calif.

[73] Assignee: Rokenbok Toy Company, Cardiff, Calif.

[21] Appl. No.: 756,428

[22] Filed: Nov. 26, 1996

[51] Int. Cl.[6] ..... A63H 33/00

[52] U.S. Cl. ..... 446/431; 473/569; 473/612

[58] Field of Search ..... 446/431, 168, 446/176, 491, 437; 473/569, 571, 613, 614, 612

[56] References Cited

U.S. PATENT DOCUMENTS

| | | | |
|---|---|---|---|
| 3,115,129 | 12/1963 | Merriman | 473/614 X |
| 3,771,789 | 11/1973 | Kammerl | 473/612 X |
| 5,480,143 | 1/1996 | McMurry | 473/613 X |

*Primary Examiner*—Mickey Yu
*Attorney, Agent, or Firm*—Ellsworth R. Roston; Fulwider Patton Lee & Utecht, LLP

[57] ABSTRACT

A marble, preferably spherical, is provided for use with safety by children even when the marble becomes swallowed by a child and becomes lodged in the child's larynx. The marble includes a body having a pair of spaced end caps. First ribs may be disposed between the end caps and may extend between the end caps in a spaced and substantially parallel relationship to one another and to the end caps. Second ribs extend between the end caps in spaced and substantially parallel relationship to one another. The pair of the second ribs at the outermost extremities of the second ribs are continuous with the first ribs. There are first slots between the first ribs and between the first ribs and the end caps. There are second slots between the second ribs. The first and second slots define holes which extend entirely through the marble to provide for continued breathing by a child when the child swallows the marble and the marble becomes lodged in the larynx of the child. The first and second slots prevent blood or saliva from accumulating along the outer periphery of the marble to block the holes defined by the slots.

23 Claims, 3 Drawing Sheets

SLOTTED MARBLE

This invention relates to a marble which can be used safely by a child and which will not harm the child even when the child swallows the marble and the marble becomes lodged in the larynx of the child.

BACKGROUND OF THE INVENTION

Marbles are used in many different games. Chinese checkers are one example of a game which uses marbles. Other games involve chutes which receive the marbles and direct the marbles to strategic locations. The marbles are spherical and have smooth surfaces. Every year there are a few children who swallow a marble and choke to death when the marble becomes lodged in their larynx. This problem has been known to exist for some time.

BRIEF DESCRIPTION OF THE INVENTION

In one embodiment of the invention, a marble, preferably spherical, is provided for use with safety by children even when the marble becomes swallowed by a child and becomes lodged in the child's larynx. The marble includes a body having a pair of spaced end caps. First ribs may be disposed between the end caps and may extend between the end caps in a spaced and substantially parallel relationship to one another and to the end caps. Second ribs extend between the end caps in spaced and substantially parallel relationship to one another. The pair of the second ribs at the outermost extremities of the second ribs are continuous with the first ribs.

There are first slots between the first ribs and between the first ribs and the end caps. There are second slots between the second ribs. The first and second slots define holes which extend entirely through the marble to provide for continued breathing by a child when the child swallows the marble and the marble becomes lodged in the larynx of the child. The first and second slots prevent blood or saliva from accumulating along the outer periphery of the marble to block the holes defined by the slots.

DETAILED DESCRIPTION OF THE INVENTION

Figure 1:
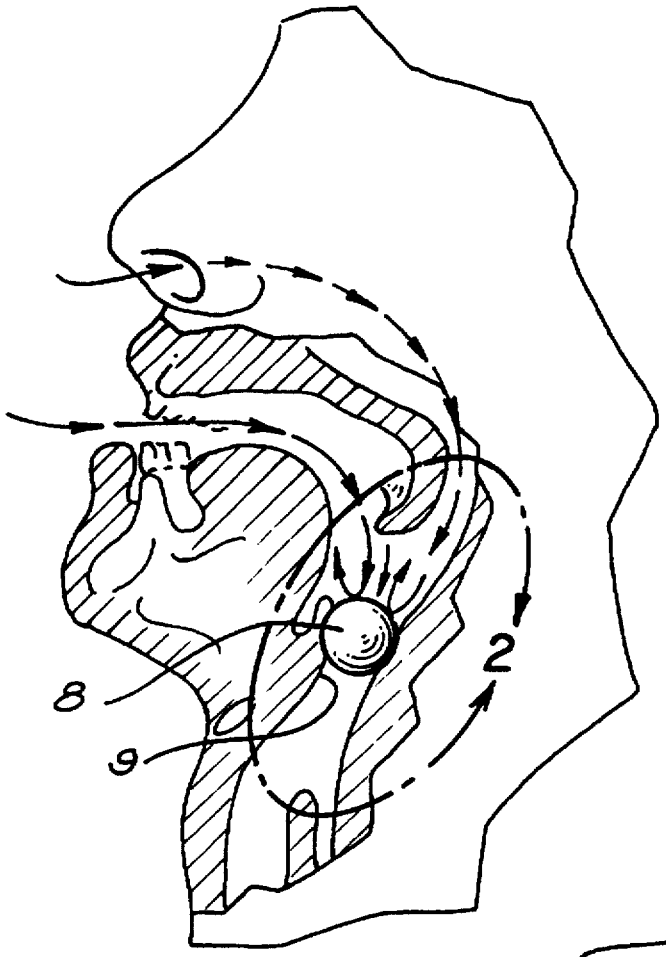
FIG. 1 is a schematic elevational view of a child's face and throat and shows a marble of the prior art, the marble being lodged in the child's larynx to prevent the child from breathing.
Figure 2:
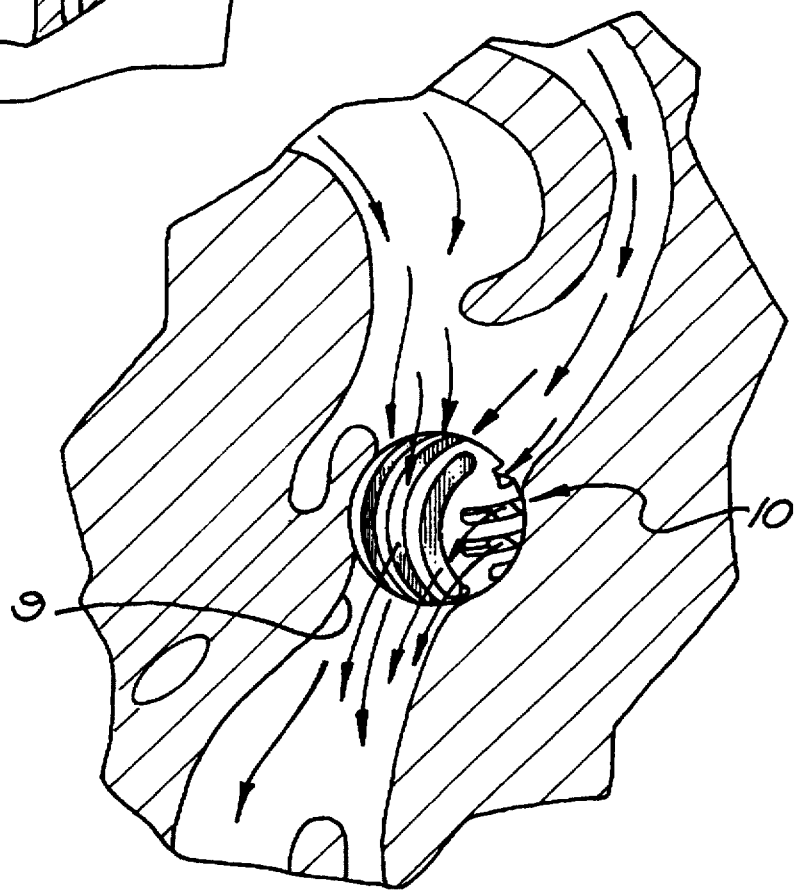
FIG. 2 is a schematic elevational view, similar to that of FIG. 1, of a child's face and throat and shows a marble of this invention, the marble being constructed to provide for the child to breathe even while lodged in the child's larynx.
Figure 3:
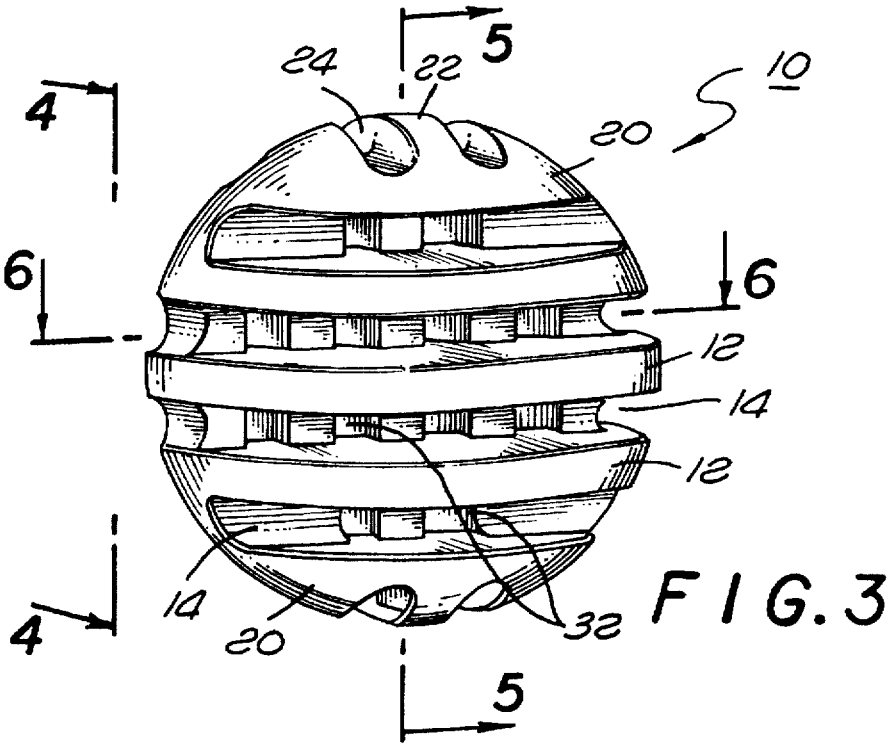
FIG. 3 is a perspective view of the marble of this invention.
Figure 4:
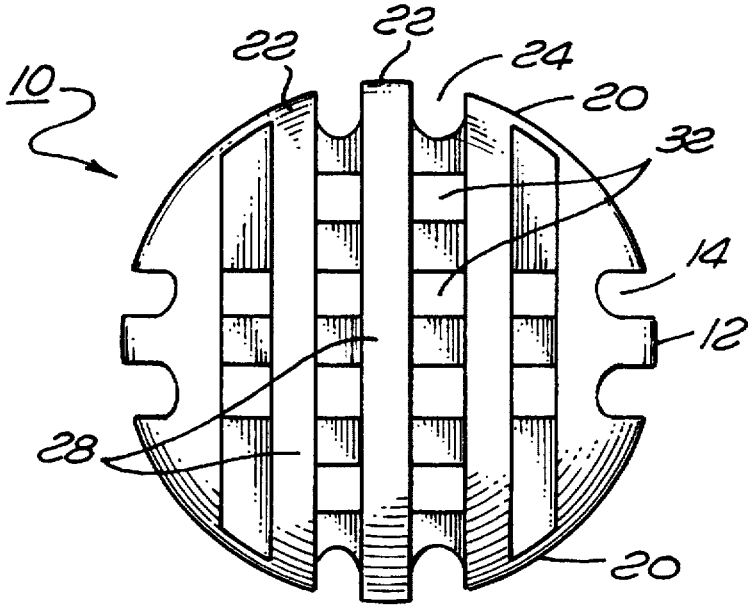
FIG. 4 is a side view taken substantially on the line 4—4 of FIG. 3.
Figure 5:
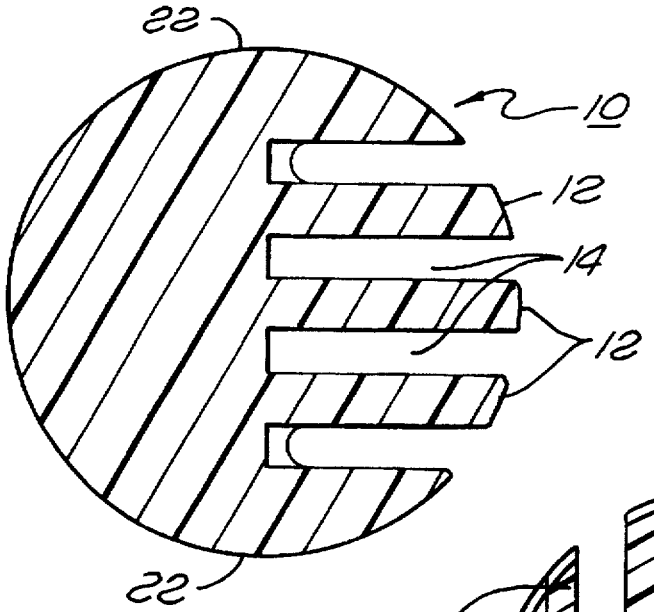
FIG. 5 is a sectional view taken substantially on the line 5—5 of FIG. 3.
Figure 6:
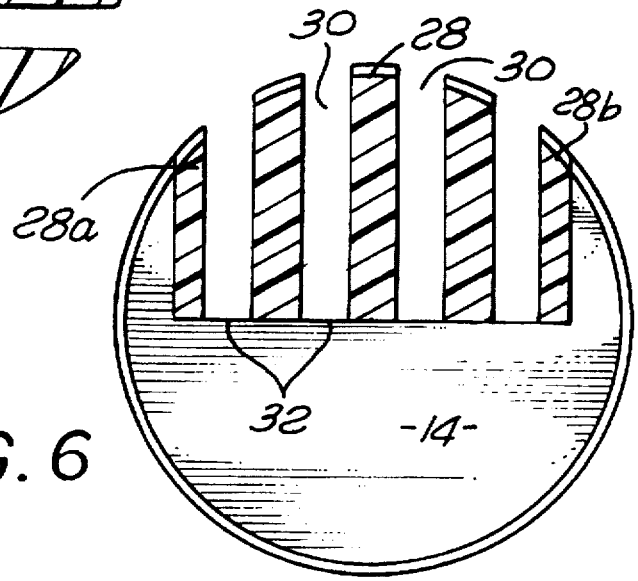
FIG. 6 is a sectional view taken substantially on the line 6—6 of FIG. 3.

FIG. 1 shows a marble 8 of the prior art. The marble 8 is generally provided with a spherical configuration. FIG. 1 shows the marble 8 lodged in the larynx 9 of a child. The marble 8 prevents the child from breathing. A number of deaths of children have been reported every year as a result of marbles 8 becoming lodged in the larynxes 9 of children.

In one embodiment of the invention, a marble generally indicated at 10 is provided with a spherical external configuration. The marble 10 is provided with slots in two (2) transverse, preferably substantially perpendicular, directions so that a child swallowing the marble will be able to breathe even when the marble becomes lodged in the child's larynx 9. These slots cause holes to extend entirely through the marble so that a child will be able to breathe even when the marble becomes lodged in the child's larynx 9. This is true regardless of the position of the marble in the child's larynx. The marble 10 may be made from an agate or from any suitable plastic material.

The marble 10 may be provided with a plurality of spaced and substantially parallel ribs 12 which extend in a first direction and which are separated from one another by substantially parallel slots 14. When the marble 10 illustratively has a diameter of approximately five eighths inch (5/8"), three (3) ribs 12 each having a width of approximately one sixteenth of an inch (1/16") may be separated from one another by slots 14 each having a width of approximately one thirty second of an inch (1/32").

End caps 20 may be provided at the opposite ends of the ribs 12. The end caps 20 are separated from the ribs 12 by the slots 14. The end caps 20 may be provided with a suitable thickness such as approximately three sixteenths of an inch (3/16"). The end caps 20 may be provided with rib portions 22 which are separated from one another by slots 24. The rib portions 22 and the slots 24 extend in a direction transverse, preferably substantially perpendicular, to the ribs 12 and the slots 14. The rib portions 22 may be provided with a suitable thickness such as approximately one sixteenth of an inch (1/16") and the slots 24 may be provided with a suitable width such as approximately one thirty second of an inch (1/32"). Three (3) rib portions 22 may be provided in each of the end caps 20.

The rib portions 22 in each of the end caps 20 are integrated by ribs 28 which extend between the end caps. The ribs 28 are provided with substantially the same thickness as the rib portions 12 and are separated by slots 30 having substantially the same thickness as the slots 14.

The ribs 28 include a first rib 28*a* defining one lateral extremity of such ribs and also include a second rib 28*b* defining an opposite lateral extremity of such ribs. The ribs 12 are integral with the ribs 28*a* and 28*b* at the opposite ends of such ribs.

As will be seen, the marble 10 is an integral structure. It is defined primarily by the ribs 12 extending in a first direction and by the ribs 28 extending in the direction transverse, preferably substantially perpendicular, to the first direction. The ribs 12 and the ribs 28 are joined essentially only by the end caps 20 and by the rib portions 28*a* and 28*b* extending between the end caps. In this way, the marble 10 provides air passages for a child to continue breathing even when the child swallows the marble and the marble becomes lodged in the child's larynx. This has been proven by tests conducted on animals.

The marble 10 disclosed above has certain important advantages. It provides holes 32 which are defined by the slots 14 and 30. The holes 32 extend entirely through the marble 10 and provide for breathing by a child even when the marble becomes lodged in the larynx 9 of the child. This is true regardless of the position of the marble 10 in the larynx 9 of the child. The slots 14 and 30 are also advantageous. They prevent saliva or blood from accumulating across the slots and blocking the free passage of air through the holes 32.

Figure 7:
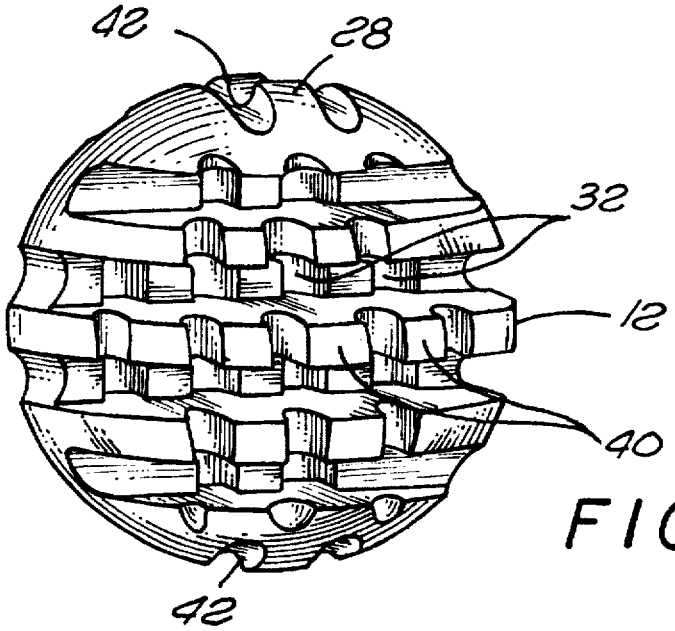
FIG. 7 is a view showing a marble constituting another embodiment of the invention.

Instead of having continuous surfaces, the ribs 12 and 28 may be respectively provided with spaced fingers 40 and 42 such as shown in FIG. 7. The spaced fingers 40 and 42 offer all of the advantages of the continuous surfaces provided by the ribs 12 and 28 as shown in FIGS. 3–6. For example, they prevent saliva and blood from collecting between the slots 14 and 30. This insures that the holes 32 will always be opened so that a child will be able to breathe regardless of the position of the marble 10 in the larynx of the child. For the purposes of the claims, the fingers may be considered to be within the definition of the word "ribs" as the word "ribs" is used in the claims.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. A marble for use with safety by children, including, a body having a plurality of first ribs extending in a first direction, the first ribs being defined by slots disposed between the first ribs in a second direction substantially perpendicular to the first direction, the body being defined in part by end caps at the opposite ends of the body in the second direction, and second ribs spaced from one another in the first direction and extending in the second direction from the end caps, the second ribs being defined by slots disposed between the second ribs in the first direction, the first and second slots defining holes which extend entirely through the slots in the first and second directions.

2. A marble as set forth in claim 1, including, the second ribs being continuous between the caps.

3. A marble as set forth in claim 2, including, the second ribs extending between the end caps, the first ribs extending between particular ones of the second ribs and communicating with such particular ones of the second ribs.

4. A marble as set forth in claim 3, including, the first ribs extending between, and being continuous with, individual ones of the second ribs defining the opposite boundaries of the second ribs in the second direction.

5. A marble as set forth in claim 3, the first and second ribs being disposed relative to one another to provide for continued breathing by a child regardless of the position of the marble in the child's larynx upon the swallowing of the marble by the child, the first and second slots being disposed and provided with dimensions to prevent spumen or blood from accumulating across the slots and blocking the passage of air through the holes.

6. A marble for use with safety by children, including, first spaced ribs extending in a first direction, a pair of end caps exterior to the first ribs and disposed in substantially parallel relationship with the first ribs, second spaced ribs extending between the end caps in a second direction transverse to the first direction, the second spaced ribs communicating at their opposite ends with at least one of the first spaced ribs, and first and second spaced slots disposed relative to one another to define holes extending entirely through the marble.

7. A marble as set forth in claim 6, including, the first spaced ribs being substantially parallel to one another, the second spaced ribs being substantially parallel to one another.

8. A marble as set forth in claim 7 wherein the second spaced ribs are substantially perpendicular to the first spaced ribs.

9. A marble as set forth in claim 6 wherein the first ribs extend between, and are continuous with, the individual ones of the second ribs defining the opposite boundaries of the second ribs in the second direction.

10. A marble as set forth in claim 9 wherein the first spaced ribs are substantially parallel to one another and wherein the second spaced ribs are substantially parallel to one another and wherein the second spaced ribs are substantially perpendicular to the first spaced ribs.

11. A marble for use with safety by a child, including, a body having a pair of spaced end caps and having first ribs disposed between the end caps and extending in spaced and substantially parallel relationship to one another and to the end caps, and second ribs extending between the end caps in spaced and substantially parallel relationship to one another, individual ones of the second ribs being continuous with the first ribs, the spaced first ribs and the spaced second ribs being disposed relative to one another to provide for continued breathing by a child regardless of the positioning of the marble in the child's larynx.

12. A marble as set forth in claim 11, including, the individual ones of the second ribs being the pair of the second ribs at the outermost extremities of the second ribs.

13. A marble as set forth in claim 11, including, there being first slots between the first ribs and between the first ribs and the end caps, there being second slots between the second ribs, the first and second slots being disposed relative to one another to define holes providing for continued breathing by a child regardless of the position of the marble in the larynx of the child when the marble is swallowed by a child, the first and second slots having dimensions to prevent the slots from being blocked by spumen or blood and to provide for the flow of air through the holes regardless of the position of the marble in the larynx of the child.

14. A marble as set forth in claim 13, including, the first and second ribs having a transverse relationship and the s pacing between the ribs defining slots with dimensions to provide the child's blood or saliva from blocking the slots.

15. A marble, including, a plurality of first spaced ribs defined by first slots between the first ribs and extending in a first direction, a plurality of second spaced ribs defined by second slots between the second ribs and extending in a second direction transverse to the first direction, and means integrating the first ribs to particular ones of the second ribs at the opposite ends of the first ribs, the first and second slots defining holes extending completely through the marble.

16. A marble as set forth in claim 15, including, the second ribs being substantially perpendicular to the first ribs and the first and second slots being disposed and being provided with dimensions to prevent the child's saliva and blood from covering the slots.

17. A marble as set forth in claim 15 wherein the marble has a substantially spherical configuration.

18. A marble as set forth in claim 15 wherein the integrating means are disposed only at one end of the second ribs.

19. A marble as set forth in claim 16 wherein the marble has a substantially spherical configuration, the integrating means are disposed only at one end of the second ribs.

20. A marble as set forth in claim 15 wherein the second ribs are disposed at positions beyond the first ribs in the second direction and wherein the integrating means include rib portions extending in the second direction to integrate the second ribs and wherein the first ribs are integrated to particular ones of the rib portions.

21. A marble as set forth in claim 20 wherein the particular ones of the rib portions constitute the rib portions which define the outermost ones of the first ribs.

22. A marble, including, first ribs extending in a first direction, there being first slots between the first ribs, second ribs extending in a second direction transverse to the first direction, there being second slots between the second ribs, the second ribs being displaced from the first ribs so that there is no intersection between the first and second ribs, and means disposed at the opposite ends of the first ribs for integrating the second ribs with the first ribs, the first and second slots being disposed and being provided with dimensions to prevent saliva and blood from covering the slots.

23. A marble as set forth in claim 22, including, the first ribs being spaced from one another in the second direction, the second ribs being spaced from one another in the first direction, the first and second slots defining holes extending completely through the marble.

* * * * *